US007419186B2

(12) United States Patent
Murakami et al.

(10) Patent No.: US 7,419,186 B2
(45) Date of Patent: Sep. 2, 2008

(54) WORKING MACHINE

(75) Inventors: Masaaki Murakami, Hiroshima (JP); Tomohiko Ochi, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 393 days.

(21) Appl. No.: 11/275,984

(22) Filed: Feb. 8, 2006

(65) Prior Publication Data

US 2006/0230650 A1 Oct. 19, 2006

(30) Foreign Application Priority Data

Mar. 29, 2005 (JP) ..... 2005-095837

(51) Int. Cl.
*E02F 9/00* (2006.01)
*E02F 9/16* (2006.01)

(52) U.S. Cl. ..... 280/781; 180/89.13; 296/209; 296/208

(58) Field of Classification Search ..... 280/781; 180/89.13; 296/193.07, 204, 205, 208, 209
See application file for complete search history.

(56) References Cited

U.S. PATENT DOCUMENTS 6,666,500 B2 * 12/2003 Polzer et al. ..... 296/187.12

FOREIGN PATENT DOCUMENTS

| | | | |
|---|---|---|---|
| JP | 11-200407 | | 7/1999 |
| JP | 2001317081 | A * | 11/2001 |
| JP | 2002180497 | A * | 6/2002 |
| JP | 2002294744 | A * | 10/2002 |

* cited by examiner

*Primary Examiner*—Kevin Hurley
*Assistant Examiner*—Nicole Verley
(74) *Attorney, Agent, or Firm*—Oblon, Spivak, McClelland, Maier & Neustadt, P.C.

(57) ABSTRACT

A working machine includes a pipeline disposed along a side deck in a front-back direction and connecting a hydraulic pump and a control valve. The hydraulic pump is mounted at a back portion of an upper frame of an upper rotating body and the control valve is mounted at a front portion of the upper frame. In the working machine, a reinforcing member having a space for accommodating the pipeline is mounted in the front-back direction of the side deck to an outermost side of the side deck in a widthwise direction thereof. The pipeline is passed through the reinforcing member.

5 Claims, 4 Drawing Sheets

WORKING MACHINE

BACKGROUND OF THE INVENTION

1. Field of the Invention

The present invention relates to a working machine in which an upper frame of an upper rotating body has a piping structure.

2. Description of the Related Art

In an upper frame of a hydraulic excavator, a pipeline connecting front and back hydraulic devices may be disposed in a front-back direction through left and right side decks.

For example, when a hydraulic pump is disposed at a back portion of the frame and a main control valve for operating a hydraulic actuator is disposed at the side deck, an oil supply/discharge pipeline connecting the pump and the valve is disposed so as to pass below the side deck.

Japanese Unexamined Patent Application Publication No. 11-200407 discloses a structure for installing a pipeline at an inner surface of a decorative cover which is disposed at an outer side of a side deck.

In the former method of passing the pipeline below the side deck, since the pipeline is directly pushed by an upward force from below by, for example, soil and stones, it tends to be damaged or to break. In addition, since steps are actually formed at a plurality of locations in front and back portions of the side deck, the pipeline must be passed through holes that are formed in the steps. Therefore, the strength of the deck is reduced by the holes.

The pipeline may be passed below the steps and covered with a protective cover. However, since the protective cover, itself, may be damaged by an upward pushing force from below it, the reliability with which the pipeline is protected is low. Therefore, costs are increased.

In the latter technology, since the pipeline is covered with a decorative cover which has a greater tendency to come into contact with obstacles than the protective cover and which has low strength/rigidity, the pipeline is not sufficiently protected. In addition, since the pipeline must be secured to the inner surface of the decorative cover, the pipework becomes troublesome.

SUMMARY OF THE INVENTION

Accordingly, it is an object of the present invention to provide a working machine which can reliably protect a pipeline connected to front and back hydraulic devices through a side deck, which can eliminate the problem of the strength of the side deck being reduced, which simplifies pipework, and which is advantageous in terms of costs.

The working machine according to the present invention has the following basic structure.

The working machine comprises an upper rotating body, a pipeline, and a reinforcing member. The upper rotating body is rotatably mounted on a lower traveling body and includes an upper frame. The upper frame includes a center section and left and right side decks. A working device is mounted to a front portion of the center section. The pipeline connects a back device and a front device and is disposed in a front-back direction along one of the side decks. The front device and the back device are disposed at a front portion and a back portion of the upper frame, respectively. The reinforcing member is disposed at an outermost side of the one of the side decks in a widthwise direction of a body of the working machine and has a space for accommodating the pipeline. The pipeline is inserted in the space of the reinforcing member.

According to the present invention, a reinforcing member including a piping frame which has a space for accommodating the pipeline and which serves as a reinforcing member is disposed in a front-back direction at an outermost side of a side deck in a widthwise direction where the pipeline is installed, and the pipeline is passed through the reinforcing member. Therefore, the piping frame receives an upward pushing force or a sideways shock and reliably protects the pipeline. Consequently, it is possible to prevent the pipeline from becoming damaged or from breaking.

In addition, it is desirable for the reinforcing member, required to provide the side deck with sufficient strength and rigidity, to have a structure allowing it to serve as a piping frame. In this case, since it is not necessary to additionally use a special-purpose duct (or a protective cover), it is possible to reduce costs and to overcome the problem of the strength of the side deck being reduced when a piping through hole is formed in the side deck.

Since, it is only necessary to pass the pipeline through the piping frame, unlike the related art, additional operations, such as securing the pipeline to the inner surface of a decorative cover, are not required, thereby facilitating pipework.

DESCRIPTION OF THE PREFERRED EMBODIMENTS

An embodiment of the present invention will be described with reference to FIGS. 1 to 7.

In the description below, a hydraulic excavator will be taken as an example to which the present invention is applied.

Here, a mini-excavator which is called an excavator with short tail swing radius is taken as an example of the hydraulic excavator. In the mini-excavator, an upper rotating body rotates within an excavator width.

Figure 6:
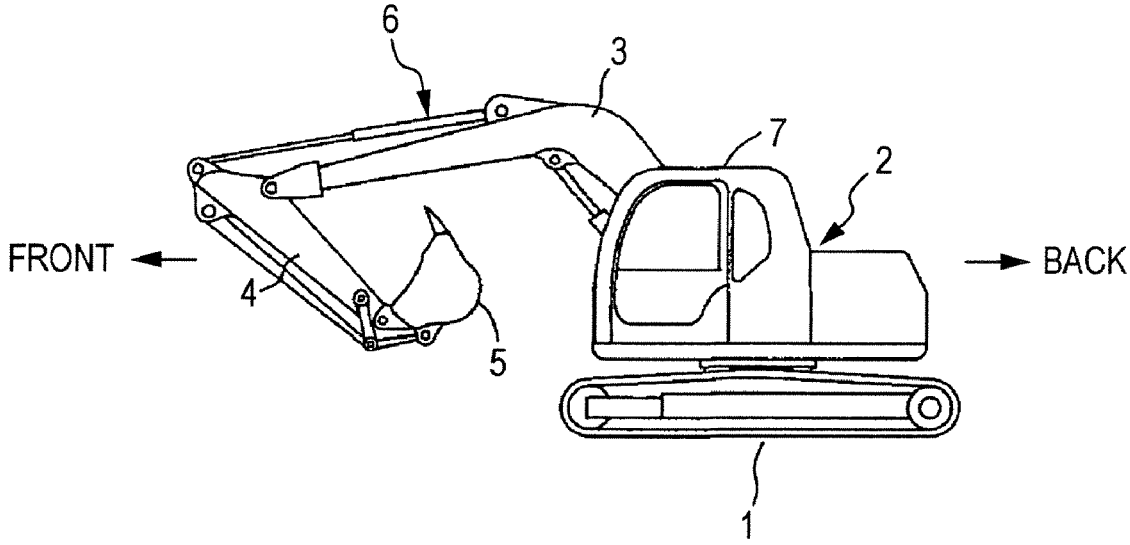
FIG. 6 is a schematic side view of a hydraulic excavator which is an example to which the present invention is applied.
Figure 7:
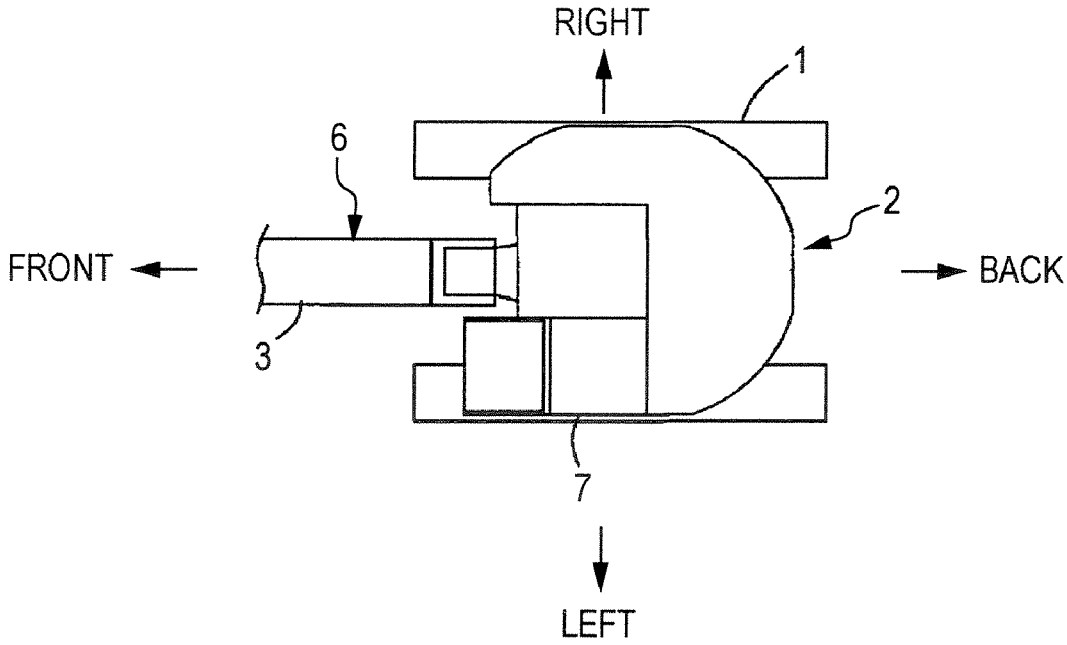
FIG. 7 is a schematic plan view of the hydraulic excavator shown in FIG. 6.

In FIGS. 6 and 7, reference numeral 1 denotes a crawler-type lower traveling body, and reference numeral 2 denotes an upper rotating body rotatably mounted on the lower traveling body 1. A working attachment (excavating device) 6 including a boom 3, an arm 4, and a bucket 5 is mounted to a front portion of the upper rotating body 2, and a cabin 7 is disposed at a left front portion of the upper rotating body 2.

Figure 1:
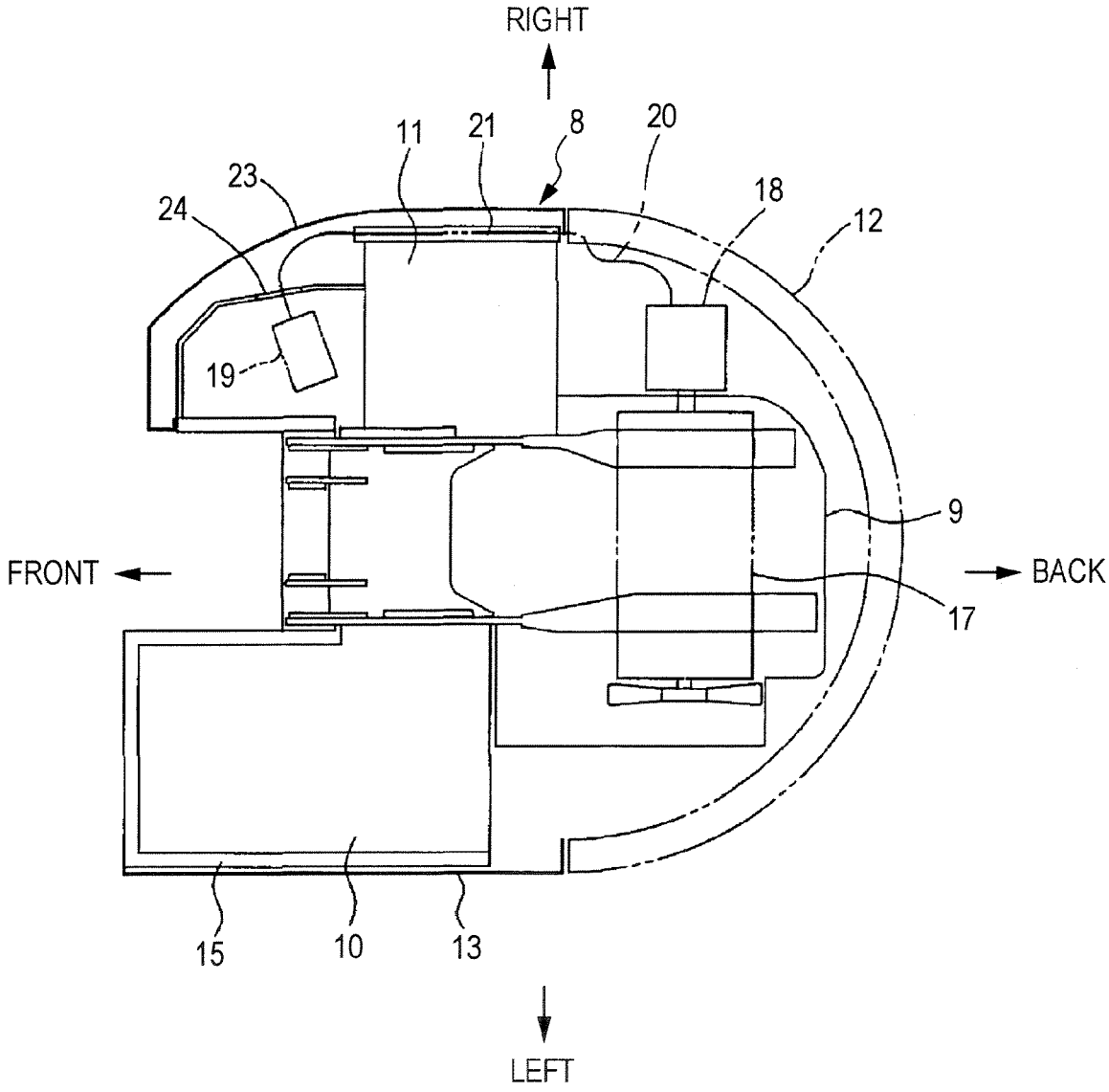
FIG. 1 is a schematic plan view of an upper frame of a working machine according to an embodiment of the present invention.

FIG. 1 is a schematic plan view of an upper frame 8 serving as the body of the upper rotating body 2. Here, for the sake of simplifying FIG. 1, only the minimum number of parts of the frame will be shown. Therefore, for example, the structure for mounting the equipment will not be shown.

The upper frame 8 is formed by disposing a left side deck 10 on the left of a center section 9 to which the working attachment 6 is mounted and by disposing a right side deck 11 on the right of the center section 9. The cabin 7 shown in FIGS. 6 and 7 is mounted to the left side deck 10, and various devices are mounted to the right side deck 11.

In FIG. 1, reference numeral 12 denotes a substantially arc-shaped counterweight mounted to a back end of the upper frame 8. As shown in FIG. 1, left and right ends of the counterweight 12 are mounted close to back ends of the side decks 10 and 11.

Reference numerals 13 and 23 denote decorative covers disposed at an outer side of the left side deck 10 and an outer side of the right side deck 11, respectively. A reinforcing member 15 for reinforcing strength/rigidity is disposed at an outermost side of an outer peripheral portion of the left side deck 10 in the widthwise direction. A piping frame 21 serving as a reinforcing member for reinforcing strength/rigidity is mounted to an outermost side of the right side deck 11 in the widthwise direction.

In this embodiment, a hydraulic pump 18 serving as a back device is mounted to the back of the center section 9 in the upper frame 8 of the upper rotating body, and a main control valve 19 serving as a front device is mounted to the right side deck 11 in the upper frame 8. The hydraulic excavator in which these components are connected by pipeline such as pipes 20 for supplying and discharging oil is taken as an example to which the present invention is applied.

Since, for the purpose of reducing the weight of the machine, the entire left side deck 10 and the entire right side deck 11 are formed of plates, the strength and rigidity of each of the left side deck 10 and the right side deck 11 are basically low. Therefore, the above-described reinforcing members are provided.

Figure 2:
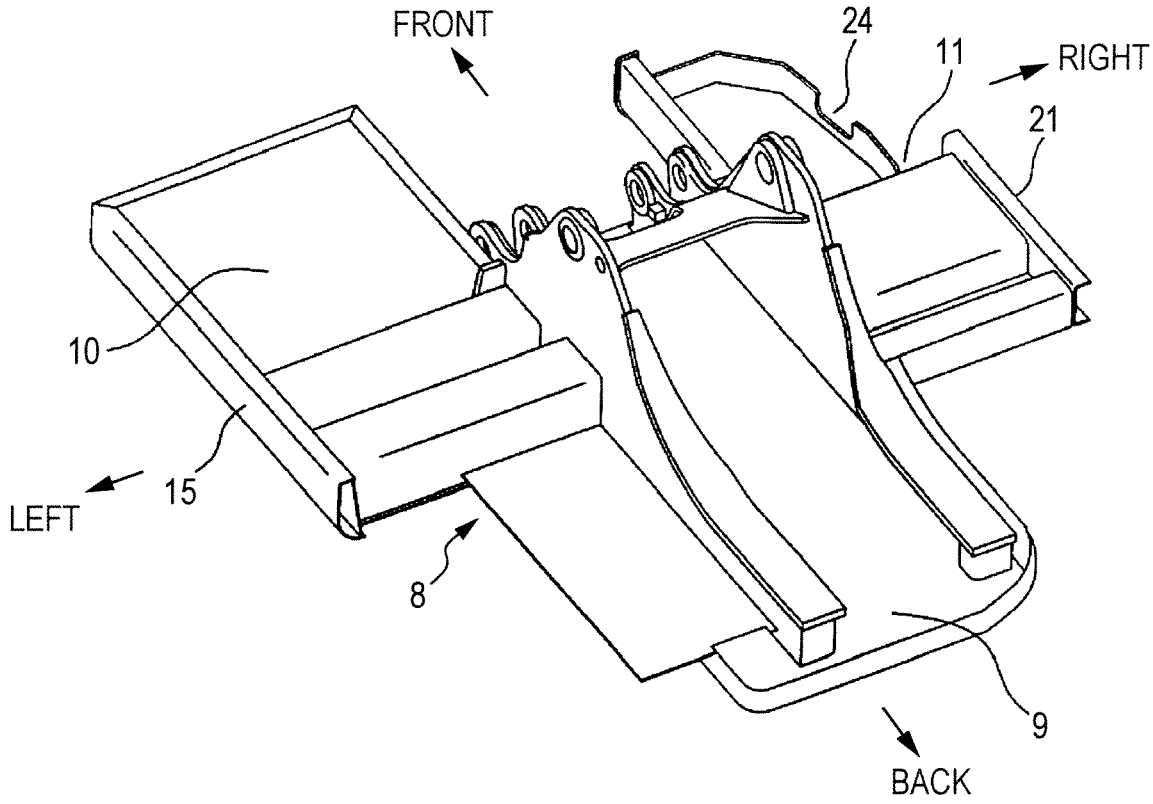
FIG. 2 is a perspective view of the upper frame shown in FIG. 1.

Here, the reinforcing member 15 (which is a hollow member called a D tube because it is D-shaped in cross section as shown in FIG. 2) is disposed at the outer peripheral portion of the left side deck 10.

The piping frame 21, serving as a reinforcing member and being C-shaped in cross section so that one side opens outward, is disposed at the outermost side of the right side deck 11 in the widthwise direction.

The piping frame 21 is formed with a section size satisfying the following conditions.

(i) The piping frame 21 predeterminately reinforces the strength and rigidity of the right side deck 11.

(ii) An internal space S (shown in FIG. 4) has a size which allows the pipes 20 and 20 (two for supplying and discharging oil in the illustrated example) passing along the right side deck 11 to be accommodated in the piping frame 21 while the pipes 20 and 20 are disposed vertically apart from each other by a predetermined interval.

As shown in FIGS. 1 and 2, the piping frame 21 is mounted to an end face of the outermost portion of the right side deck 11 in the widthwise direction by, for example, welding.

For the reinforcing member 15 at the left side deck 10, a rectangular cross-section hollow member which is such as to be D-shaped in cross section is used as a member exclusively for reinforcement. The vertical size and the size in the widthwise direction of the piping frame 21 are larger than those of the reinforcing member 15.

As mentioned above, the counterweight 12 may be disposed with its right end being close to the back end of the right side deck 11. In this case, the pipes 20 and 20 introduced in the piping frame 21 and the right end of the counterweight 12 may interfere with each other Accordingly, in such a case, it is recommended that a recess 22 for introducing the pipes 20 and 20 into the piping frame 21 be formed in an inner surface of the right end of the counterweight 12 as shown in FIGS. 3 and 5.

This makes it possible to prevent the pipes 20 and 20 and the counterweight 12 from interfering with each other without considerable modifications such as changing the shape or position of the counterweight 12.

Figure 3:
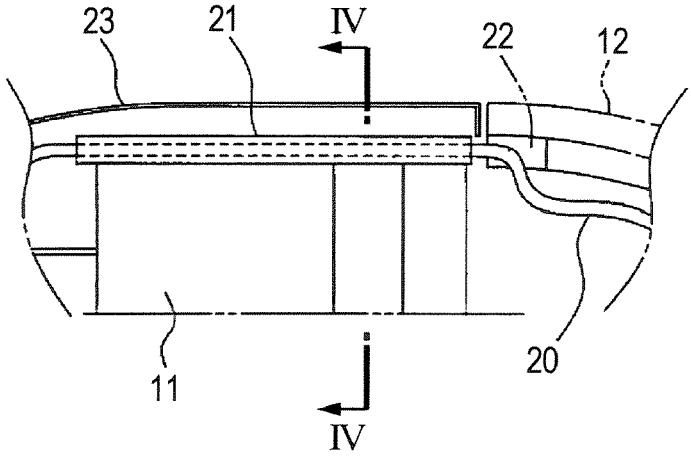
FIG. 3 is an enlarged view of a portion shown in FIG. 1.
Figure 4:
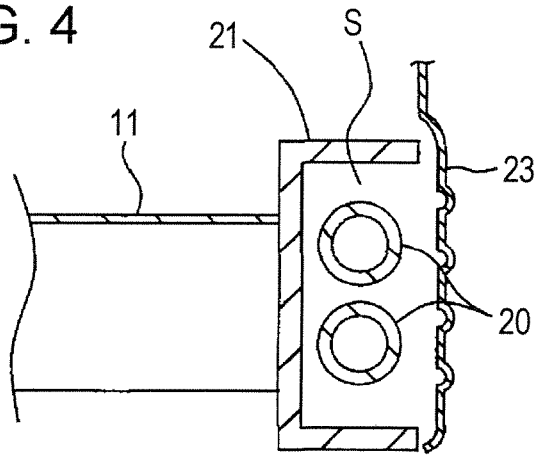
FIG. 4 is an enlarged sectional view taken along line IV-IV of FIG. 3.
Figure 5:
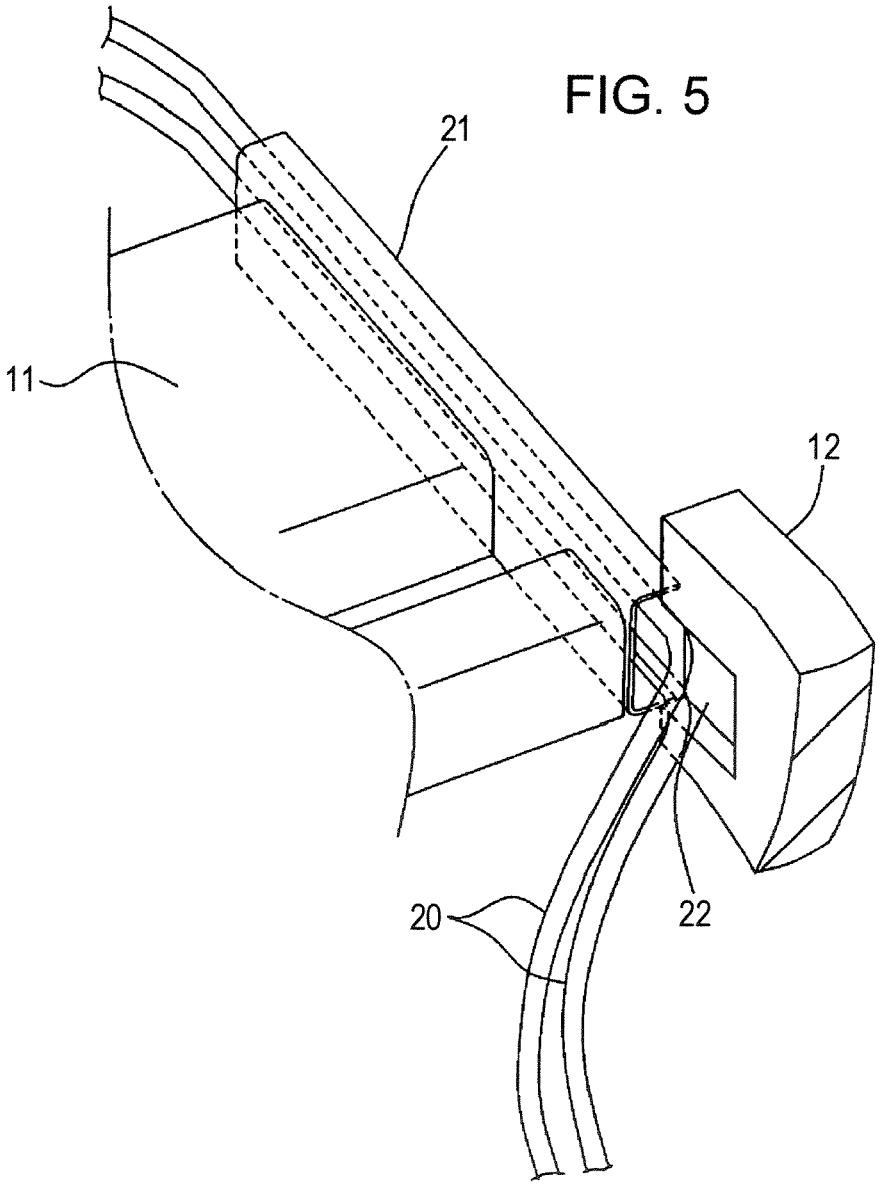
FIG. 5 is an enlarged perspective view of a portion shown in FIG. 3.

As shown in FIGS. 3 to 5, the pipes 20 and 20 which are accommodated vertically apart from each other by a predetermined interval in the piping frame 21 is passed through the piping frame 21 in the front-back direction at the outermost side of the right side deck 11 in the widthwise direction.

When pipework is carried out before mounting the counterweight 12, the pipes 20 and 20 may be pushed into the piping frame 21 from outside the piping frame 21 in the widthwise direction or may be inserted into the piping frame 21 from the front or back of the piping frame 21. After accommodating the pipes, piping stoppers (not shown) for securing the pipes 20 and 20 in the piping frame 21 by pushing them into the piping frame 21 are mounted to a plurality of locations in the front and back portions of the frame 21.

After the pipework, the decorative cover 23 for the right side deck covering the open side of the piping frame 21 from outside the piping frame 21 is mounted to the outer side of the right side deck 11.

In FIGS. 1 and 2, reference numeral 24 denotes a notch formed in the right side deck 11 for guiding the pipes 20 and 20 protruding from the piping frame 21 to the main control valve 19.

According to this piping structure, the piping frame 21 serving as a reinforcing member for the right side deck 11 is mounted to the outermost side of the right side deck 11 in the widthwise direction, so that the pipes 20 and 20 can be passed through the piping frame 21. Therefore, the piping frame 21 receives an upward pushing force from below or a sideways shock, so that the pipes 20 and 20 are reliably protected and are thus prevented from becoming damaged or from breaking.

In addition, since the piping frame 21 serves as a reinforcing member required for providing the strength and the rigidity to the right side deck 11, a special-purpose duct (or a protective cover) is not required. Therefore, costs can be reduced.

Further, the problem of the strength of the right side deck 11 being reduced when a piping through hole is formed in a step of the right side deck 11 does not occur.

Since the pipes 20 and 20 are supported by the frame 21 by only passing them through the piping frame 21, additional operations, such as securing a pipe to an inner surface of a decorative cover, carried out in the structure according to the related art do not need to be carried out. Therefore, pipework is facilitated.

In particular, according to the embodiment, one side of the piping frame 21 opens outwards in the widthwise direction of the side deck 11 (that is, the piping frame 21 is C-shaped in cross section). This allows pipework to be carried out with greater freedom, such as pushing the pipes 20 and 20 into the frame 21 from outside the frame 21 in the widthwise direction of the right side deck 11. Therefore, the pipework is further facilitated.

Since the pipes 20 and 20 can be seen from the outside when the decorative cover 23 is removed and can be easily inserted into and removed from the piping frame 21 for inspection and repair, maintenance is facilitated.

Still further, since the decorative cover 23 for the right side deck is disposed in a state in which it covers the open side of the piping frame 21 from the outside, that is, the decorative cover 23 for improving the design serves as a portion of a piping duct, it is possible to increase the effect of protecting the pipes from small obstacles, such as small stones, which may enter the open side of the piping frame 21.

Other Embodiments (1) Although, in the above-described embodiment, two pipes 20 and 20 are passed through the piping frame 21, three or more pipes may be passed through the piping frame 21. The section size of the piping frame 21 is set in accordance with the size and number of pipes.

(2) Although, from the viewpoints of pipework and maintenance, it is desirable to form the piping frame 21 with a C shape in cross section so that one side opens outwards as in the above-described embodiment, the piping frame 21 may be what is called a closed section piping frame which is closed from the outside.

(3) Although, in the above-described embodiment, the pipes are passed along the right side deck 11, they may be passed along the left side deck 10 or both of the side decks 10 and 11.

Although the invention has been described with reference to the preferred embodiments in the attached figures, it is noted that equivalents may be employed and substitutions made herein without departing from the scope of the invention as recited in the claims.

What is claimed is:

1. A working machine comprising:

a lower traveling body;

an upper rotating body rotatably mounted on the lower traveling body, the upper rotating body including an upper frame, the upper frame including a center section and left and right side decks, a working device being mounted to a front portion of the center section;

a pipeline adapted to connect a back device and a front device, the pipeline being disposed in a front-back direction along one of the side decks, the front device and the back device being disposed at a front portion and a back portion of the upper frame, respectively; and a piping frame being disposed at an outermost side of the one of the side decks in a widthwise direction of a body of the working machine, having a space for accommodating the pipeline, and serving as a reinforcing member of the one of the side decks, the pipeline being disposed so as to pass through the space of the piping frame.

2. The working machine according to claim 1, wherein the piping frame is C-shaped in cross section so that one side of the piping frame opens outward in a widthwise direction of the one of the side decks.

3. The working machine according to claim 2, further comprising a decorative cover for the one of the side decks, the cover covering the open side of the piping frame from the outside being disposed at an outer side of the piping frame.

4. The working machine according to claim 1, further comprising a counterweight mounted at a back end of the upper frame, a recess for introducing the pipeline into the piping frame being disposed in an inner surface of an end of the counterweight, the end of the counterweight being disposed close to a back end of the one of the side decks.

5. A working machine comprising:

a lower traveling body;

an upper rotating body rotatably mounted on the lower traveling body, the upper rotating body including an upper frame, the upper frame including a center section and left and right side decks, a working device being mounted to a front portion of the center section;

a pipeline adapted to connect a back device and a front device, the pipeline being disposed in a front-back direction along one of the side decks, the front device and the back device being disposed at a front portion and a back portion of the upper frame, respectively; and a reinforcing member being disposed at an outermost side of the one of the side decks in a widthwise direction of a body of the working machine and having a space for accommodating the pipeline, the pipeline being passed through the space of the reinforcing member.

* * * * *